US005253857A

United States Patent [19]

Ballestrazzi et al.

[11] Patent Number: 5,253,857

[45] Date of Patent: Oct. 19, 1993

[54] DEVICE FOR FEEDING SHEETS FROM ONE OR TWO SOURCES

[75] Inventors: Aris Ballestrazzi; Lamberto Tassi, both of Savignano Sul Panaro, Italy

[73] Assignee: SITMA S.p.A., Spilamberto, Italy

[21] Appl. No.: 921,047

[22] Filed: Jul. 28, 1992

[30] Foreign Application Priority Data

Aug. 5, 1991 [IT] Italy ..... MI91A002205

[51] Int. Cl.[5] ..... B65H 3/44

[52] U.S. Cl. ..... 271/91; 271/9; 271/10; 271/112

[58] Field of Search ..... 271/9, 10–12, 271/91, 93, 99, 112

[56] References Cited

U.S. PATENT DOCUMENTS

| | | | |
|---|---|---|---|
| 3,137,981 | 6/1964 | Johnson et al. | 271/9 |
| 3,181,860 | 5/1965 | Liebenow et al. . | |
| 3,391,924 | 7/1968 | Schmidlin et al. | 271/9 |
| 3,834,691 | 9/1974 | Paulson | 271/9 |
| 3,934,868 | 1/1976 | Selak | 271/9 |
| 4,592,542 | 6/1986 | Selak | 271/9 |
| 4,625,641 | 12/1986 | Jagosz et al. | 271/9 |
| 4,728,092 | 3/1988 | Selak | 271/9 |
| 4,843,962 | 7/1989 | Neelman et al. | 271/9 |
| 4,867,432 | 9/1989 | Matta | 271/9 |
| 5,069,434 | 12/1991 | Sellers | 271/9 |
| 5,169,285 | 12/1992 | Müller | 271/91 |

FOREIGN PATENT DOCUMENTS

| | | | |
|---|---|---|---|
| 1220387 | 7/1966 | Fed. Rep. of Germany . | |
| 69640 | 4/1983 | Japan | 271/9 |
| 77040 | 5/1985 | Japan | 271/9 |
| 196542 | 6/1938 | Switzerland | 271/12 |

*Primary Examiner*—Joseph E. Valenza
*Assistant Examiner*—Steven M. Reiss
*Attorney, Agent, or Firm*—Oblon, Spivak, McClelland, Maier & Neustadt

[57] ABSTRACT

A device for feeding single sheets to a packaging, labelling or packeting machine, comprising a support structure provided with a table for positioning a stack of sheets to be fed, at least one pair of rotary drums arranged rigid with a drive shaft, and a plurality of operating elements associated with the pair of drums and comprising gripper elements positioned on the drums for gripping the sheets and sucker elements for withdrawing a single sheet from the bottom of said stack and transporting it towards the gripper elements. The drive shaft being divided into two parts which can be connected together in an intermediate region in a relative position rotated through any angle, a first linkage system comprising levers and cams being operationally associated with the operating elements of a first drum and a second similar linkage system being associated with the operating elements of a second drum, these being arranged on each of the two drive shaft parts.

3 Claims, 5 Drawing Sheets

DEVICE FOR FEEDING SHEETS FROM ONE OR TWO SOURCES

BACKGROUND OF THE INVENTION

1. Field of the Invention

This invention relates to a device for feeding single sheets or the like to a packaging, labelling or packeting machine.

2. Discussion of the Related Art

Devices for feeding single sheets or the like, known as sheet feeders, and particularly when arranged at the side of an automatic machine for packaging products in material in the form of a continuous web, such as heat-shrinkable plastics film, enable supplementary sheets, or sheets which themselves form the total packaged product, to be positioned on an associated conveyor. These devices can also be associated in the same manner with labelling or packeting machines.

These devices are specifically constructed in such dimensions as to be able to handle stacks of sheets or the like of fairly predetermined dimensions. Hence a packaging, labelling or packeting machine which is required to handle products of different dimensions must comprise several associated devices of different dimensions which are operated as required, or alternatively specific devices must be able to be mounted on the machine. This obviously results in considerable plant costs in providing the entire necessary range of devices.

A further problem of feed devices of known type is that their operating rate is limited because of the intrinsic limits of the individual devices. To overcome this it is only possible at the moment to arrange several devices one behind the other and drive the conveyor with a pitch which is double the usual pitch, so that the supplementary sheets are loaded or arranged in positions corresponding with the required pusher elements. This greatly limits the production capacity of the packaging machine or results in a considerable increase in the plant and operating costs because of the number of devices.

A further problem connected with the known systems is that of synchronizing the various devices with each other and with the conveyor forming part of the packaging, labelling or packeting machine.

SUMMARY OF THE INVENTION

The object of the present invention is to solve the above-noted problems by means of a device which although being of low cost allows the handled product to be varied without the need for down-times, while working at the highest possible packaging, labelling or packeting rate.

This object is attained according to the present invention by a device for feeding single sheets or the like to a packaging, labelling or packeting machine, comprising a support structure provided with a table for positioning a stack of sheets to be fed, at least one pair of rotary drums arranged rigid with a drive shaft which is rotatably supported on said support structure, and a plurality of operating elements associated with said pair of drums, said operating elements comprising gripper elements positioned on said rotary drums for gripping said sheets and sucker elements for withdrawing a single sheet from the bottom of said stack and transporting it towards said gripper elements, a linkage system comprising levers and cams being provided in proximity to a first end of said drive shaft for controlling said device operating elements in phase, characterised in that said drive shaft is divided into two parts which can be connected together in an intermediate region via ends provided with removable engagement means and be secured in a relative position rotated through any selectable angle, said linkage system comprising levers and cams being operationally associated with the operating elements of a first drum of the device, a second linkage system comprising levers and cams being provided in proximity to the other end of said drive shaft and being associated with the operating elements of a second drum of the device.

BRIEF DESCRIPTION OF THE DRAWINGS

Characteristics and advantages of a device according to the present invention will be more apparent from the description of a possible embodiment thereof given hereinafter by way of non-limiting example with reference to the accompanying drawings, in which.

DESCRIPTION OF THE PREFERRED EMBODIMENTS

Figure 1:
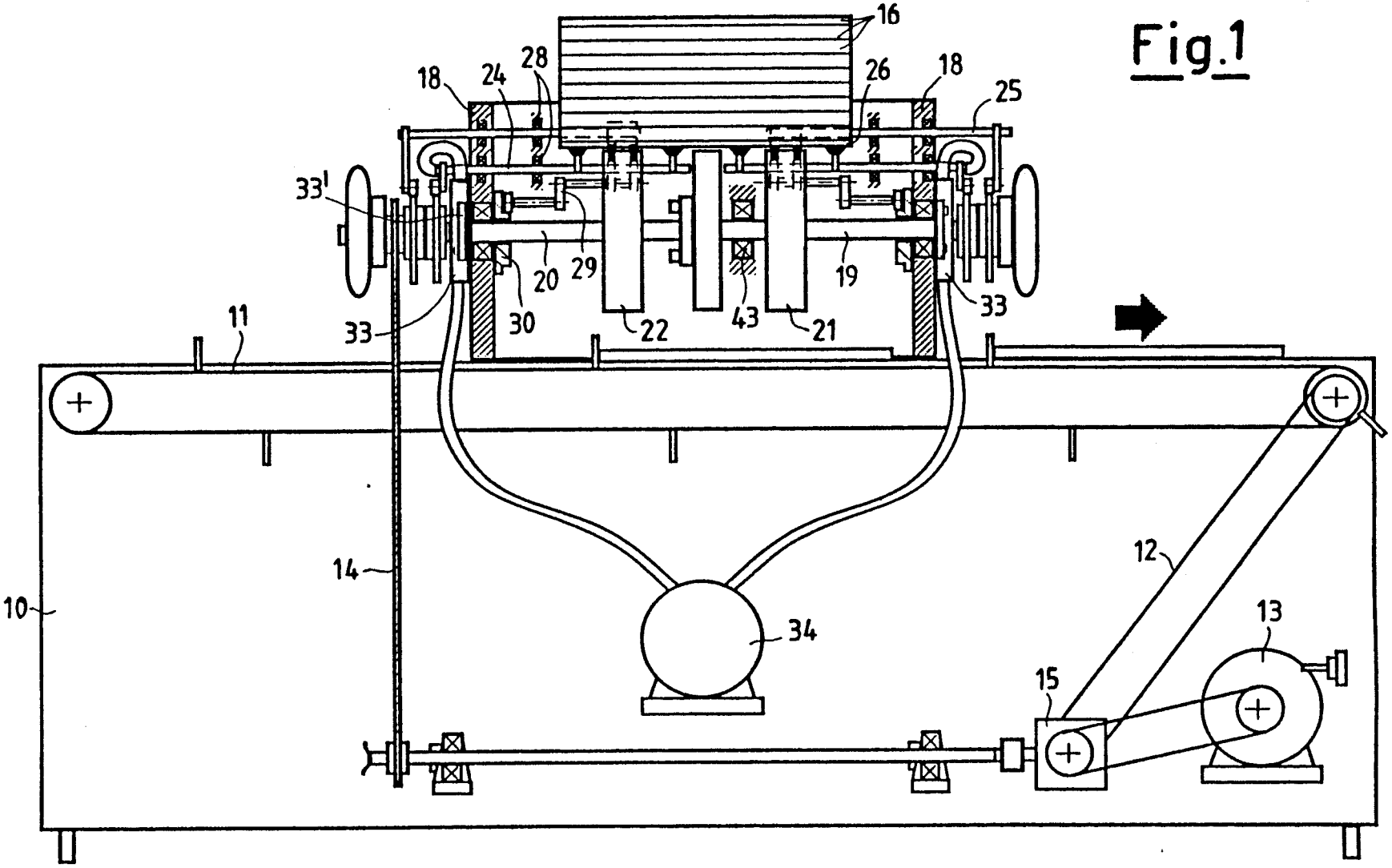
FIG. 1 is a side elevational view of a device according to the invention applied for example to the side of a packaging machine.
Figure 2:
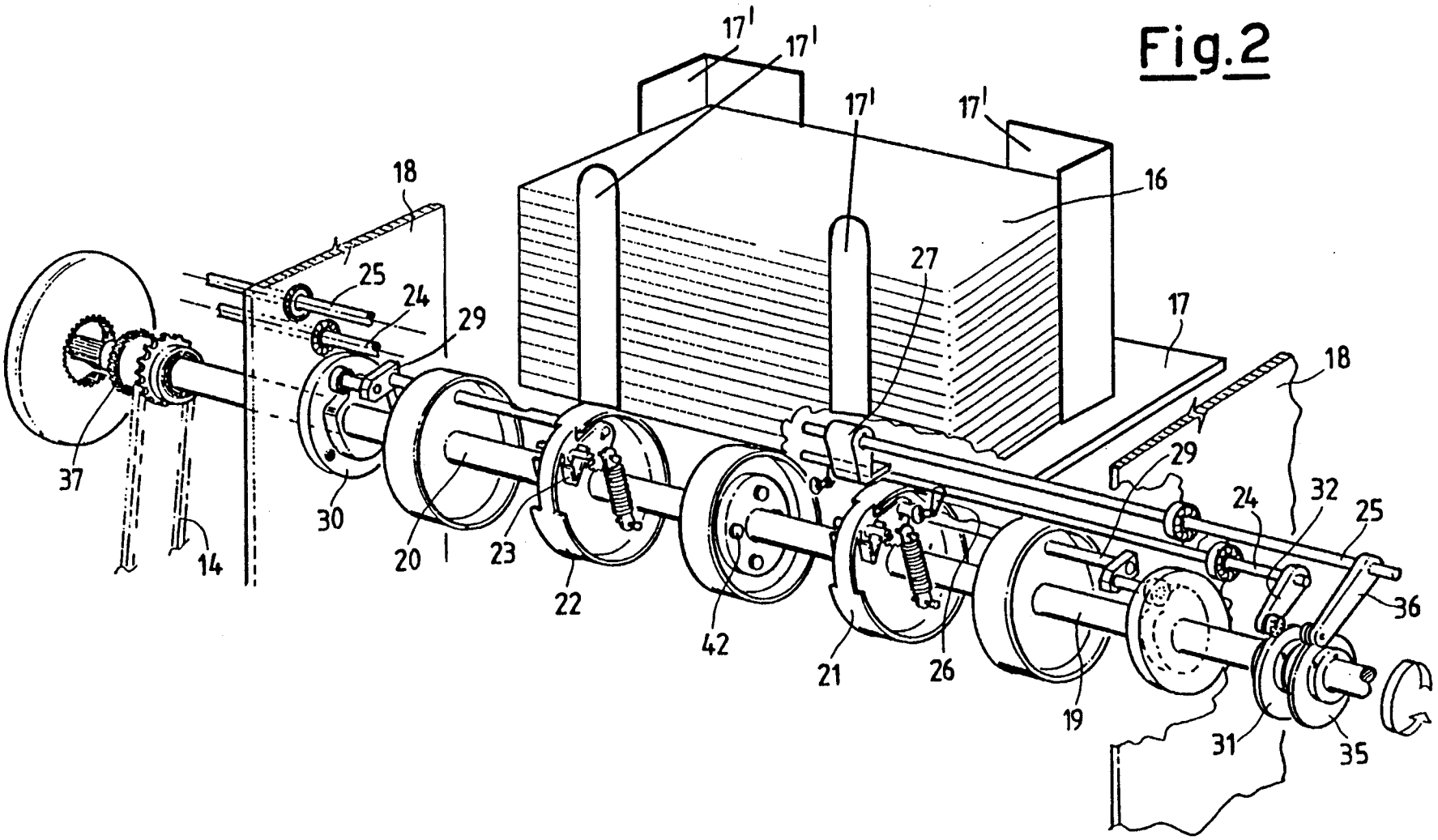
FIG. 2 is a perspective view of part of the device of FIG. 1.

With reference to the figures, a packaging machine conveyor 11 of pusher type is shown schematically on a frame 10, and is driven by a central variable speed motor 13 via a reduction gear 15 and a composite transmission 12. The variable speed motor 13 also operates a feed device according to the present invention by way of the reduction gear 15 and a further chain transmission 14. This device can be equally associated with a labelling or packeting machine.

The device according to the invention separately feeds single sheets 16 or the like, stacked on a stacking table 17 which is complete with vertical restraining guides 17' adjustable to the product format and is rigid with lateral shoulders 18 of a support structure which extend vertically from the frame 10, to the pusher conveyor 11 or rather to a position corresponding with the individual pushers passing one after another along the conveyor. This device is of the rotary loader type for feeding the sheets 16, and comprises between the two shoulders 18 below a stacking region a drive shaft in two parts 19 and 20, each carrying a rotary drum 21 and 22. In this manner the device of the invention consists of two specularly symmetrical parts fixable to each other by removable engagement means at any selectable angle offset from each other. Each rotary drum 21, 22 carries gripper elements 23, for example of curved profile, which ensure gripping of the sheets 16.

Between the two shoulders 18 there are also provided two pairs of transverse spindles 24 and 25, of which the first pair 24 supports sucker elements 26 for withdrawing a single sheet 16 from the bottom of the stack or stacks positioned on the stacking region and transporting it to the gripper elements 23. The second pair of spindles 25 supports a plurality of teeth 27 for supporting the front and the rear of the stacked sheets 16. The pairs of spindles 24 and 25 are rotatably supported both within the shoulders 18 and in further supports 28 in the device frame. The gripper elements 23 of the two parts of the device are operated by a first pair of shaped control levers 29, the ends of which interact with a first pair of cams 30 rigid with the two parts 19 and 20 of the drive shaft when rigidly connected together. The two parts 19 and 20 of the drive shaft each carry a second pair of cams 31 for controlling a second pair of levers 32 rigid with the pair of spindles 24 carrying the sucker elements 26. These spindles are internally hollow and are connected, via a pair of rotary distributors 33 comprising valves with communication slots 33', to a vacuum pump 34 positioned within the frame 10. A third pair of cams 35, also rigid with the two shaft parts 19 and 20, rotates via a further pair of levers 36 the spindles 25 carrying the support teeth 27 for the sheets 16. At least one of the two ends of the two drive shaft parts 19 and 20 carries a clutch element 37 which enables the drive shaft 19, 20 to be correctly positioned relative to the transmission 14 and conveyor 11.

Figure 3:
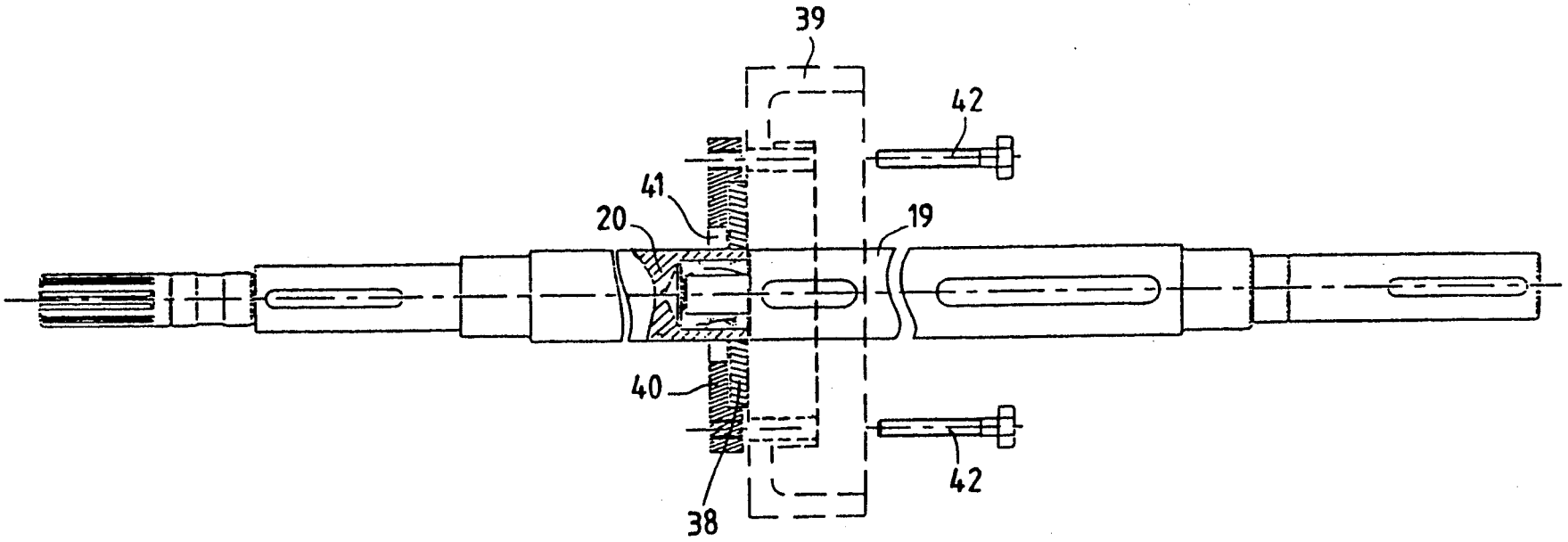
FIG. 3 is an exploded partly sectional side elevation of the drive shaft of the device of FIG. 1.

As stated heretofore, engagement means are provided between the two drive shaft parts 19, 20 as shown in FIG. 3. These engagement means, which are removable and fixable in a position rotated through any necessary chosen angle, consist of a small flat flange 38 made radially rigid with, for example by welding, and projecting from, the first part 20 of the shaft, and a second flange 39 of larger dimensions keyed onto the second part 19 of the drive shaft. A backing flange 40 can be mounted via a central hole 41 onto the drive shaft part 20 to externally embrace the flange 38. The surface of the backing flange 40 acts by friction against the facing surface of the small flange 38, and with the aid of bolts 42 inserted through respective holes in the two coupled parts securely locks the two shaft parts 19 and 20 in the required rotated position. When the type of operation is to be changed, the engagement means can be very rapidly and easily adjusted by merely slackening the bolts. That shaft part not connected to the transmission 14 is then rotated as required, and the bolts are again tightened to securely lock the parts together. For better positioning and better operation of the drive shaft 19, 20, at least one of the two parts can be provided with an intermediate support element 43.

A feed device according to the invention hence comprises a first linkage system of lever and cam type for controlling the operating elements associated with the first drive shaft part and a second linkage system of lever and cam type for controlling the operating elements associated with the second drive shaft part. The operating elements can be set for handling either sheets of one stack or sheets of two side-by-side stacks by simply disengaging the relative means provided on the facing ends of the two drive shaft halves and repositioning them in accordance with the required phase difference.

This facility for differing the time at which the sheets of two possible side-by-side stacks are gripped enables them to be transported and released onto the conveyor of the packaging, labelling or packeting machine in accordance with various procedures. In addition, correct timing of the feed can be advantageously achieved relative to the pusher pitch or the product dimensions.

In this respect, in a first arrangement (FIG. 1) in which the two linkage systems are mutually aligned, sheets can be fed from a single stack as if the device were a feeder of known type. In this manner sheets or the like of considerable individual dimensions can be handled. The cams and levers relative to the sucker elements, to the gripper elements and to the vacuum pump connection control etc. are preferably operated simultaneously so as to simulate a single sheet handling device.

Figure 4:
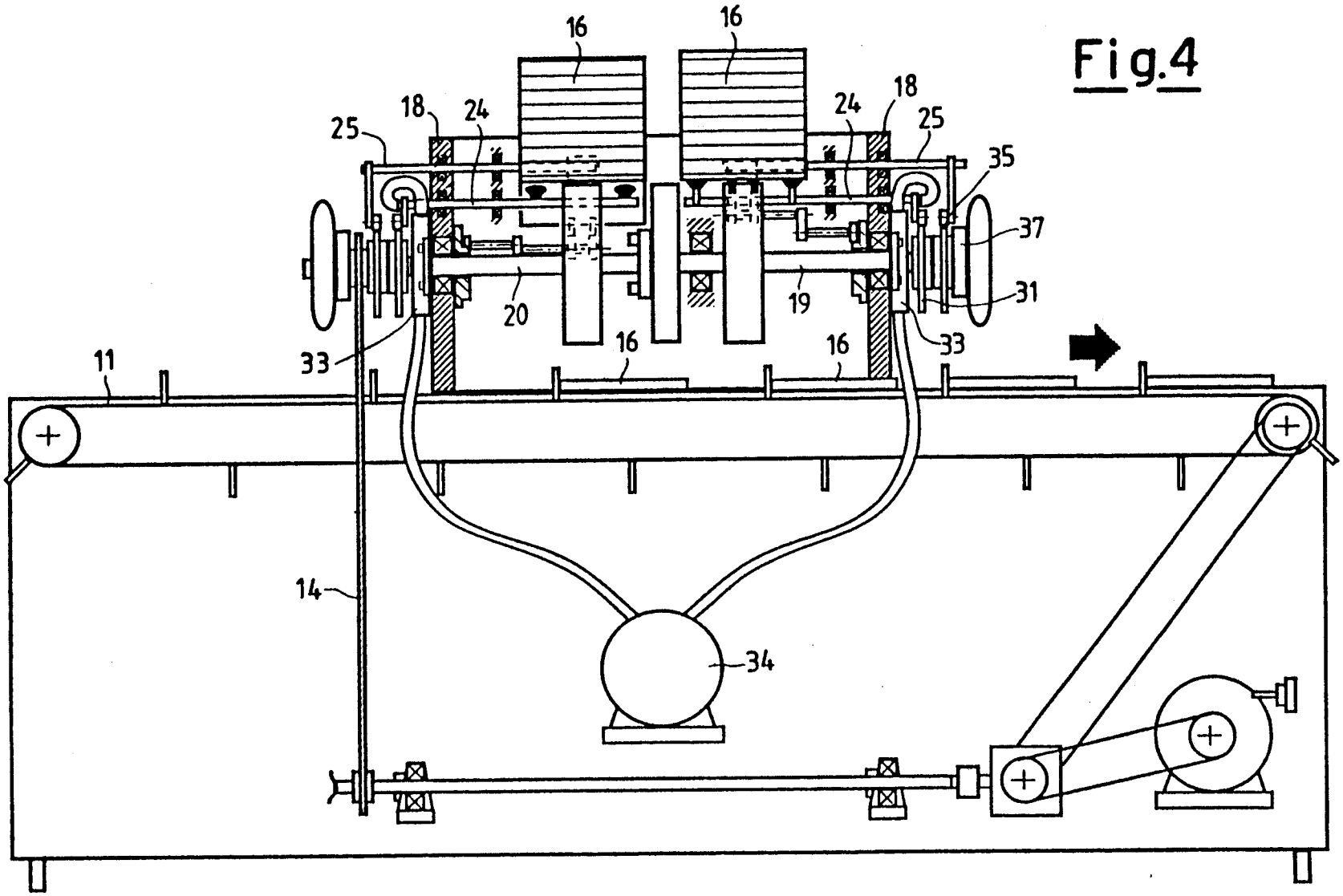
FIGS. 4 and 5 are views similar to FIG. 1 showing different arrangements and operating positions.

In a second arrangement (FIG. 4), by initially phase-differing the two linkage systems and advancing the conveyor through two pushers subsequent to each feed, the sheets of two side-by-side stacks can be fed at successive pushers, so doubling the feed capacity of the device. At each sheet feed from one stack the conveyor advances through two successive pushers.

Figure 5:
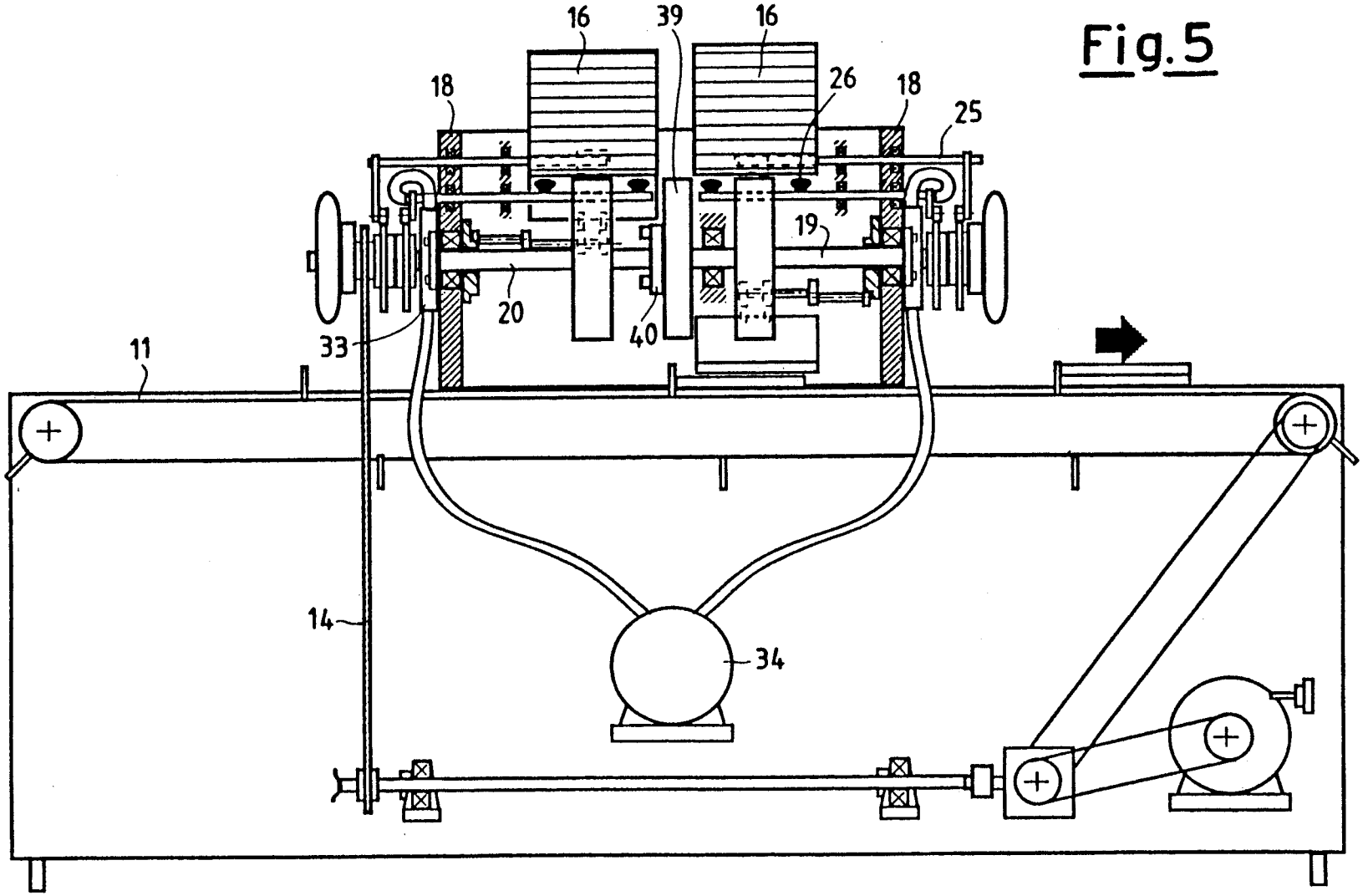

In a third arrangement (FIG. 5), by further phase-differing the two linkage systems and advancing the conveyor, the two sheets of two side-by-side stacks can be fed one onto the other at each individual pusher so doubling the feed capacity of the device. In this case one half the number of pushers required for the preceding case is sufficient.

In addition a device according to the invention enables the machine to still operate but with reduced feed of supplementary sheets or the like should one half of the device develop a fault, so preventing complete stoppage of the packaging, labelling or packeting machine.

In an alternative embodiment, not shown, the drive shaft can be formed in several parts with several associated linkage systems and a like number of engagement means, to achieve an increased operating capacity.

The particular simplicity of the engagement means between the two drive shaft parts allows the device to be easily and quickly adapted to the required type of operation.

We claim:

1. A feeding device for separately feeding single sheets from at least one stack of sheets, comprising:

a support structure provided with a table for positioning a stack of sheets to be fed;

at least one pair of rotary drums rigidly positioned with a drive shaft which is rotatably supported on said support structure;

a plurality of operating elements associated with said pair of drums, said operating elements comprising gripper elements positioned on said rotary drums for gripping said sheets and sucker elements for withdrawing a single sheet from the bottom of said stack and transporting the single sheet towards said gripper elements; and a linkage system comprising levers and cams provided in proximity to the first end of said drive shaft for controlling said operating elements so as to provide for a phase difference; wherein:

said drive shaft is divided into two parts which can be connected together in an intermediate region at ends of each of said parts, the ends of each of said parts being provided with removable engagement means and being capable of being secured in a relative position and rotated through any selectable angle;

said linkage system that comprises levers and cams operationally connected with the operating elements of a first drum of the device; and a second linkage system comprising levers and cams is provided in proximity to the other end of said drive shaft and is operationally connected with the operating elements of a second drum of the device.

2. A device as claimed in claim 1, wherein said engagement means consist of a first flat flange radially rigid with and projecting from one of said parts of said drive shaft, a second flange of larger dimensions keyed onto another of said drive shaft parts, and a backing flange mountable via a central hole onto said one drive shaft part and externally embracing said first flange, a surface of said backing flange acting by friction against the facing surface of said first flange with the aid of bolts insertable through respective holes provided in the flanges.

3. A device as claimed in claim 1, wherein said drive shaft can be connected at one end via a transmission to a central drive unit by way of a clutch element.

* * * * *